US007200350B2

(12) United States Patent
Agata et al.

(10) Patent No.: US 7,200,350 B2
(45) Date of Patent: Apr. 3, 2007

(54) IMAGE FORMING APPARATUS SWITCHING DEVELOPING ROLLERS OF MOUNTED PROCESS CARTRIDGES BETWEEN CONTACT AND SPACED STATES AND SWITCHING THE CONTACT POSITION OF A FEEDING BELT CONTACTABLE TO DRUMS OF THE MOUNTED CARTRIDGES

(75) Inventors: Shinichi Agata, Shizuoka-ken (JP); Shinya Yamamoto, Numazu (JP); Kohei Matsuda, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/030,040

(22) Filed: Jan. 7, 2005

(65) Prior Publication Data

US 2005/0152716 A1 Jul. 14, 2005

(30) Foreign Application Priority Data

Jan. 9, 2004 (JP) ..... 2004-004117
Dec. 15, 2004 (JP) ..... 2004-362868

(51) Int. Cl.
*G03G 15/16* (2006.01)

(52) U.S. Cl. ..... 399/223; 399/45

(58) Field of Classification Search ..... None
See application file for complete search history.

(56) References Cited

U.S. PATENT DOCUMENTS 5,528,341 A 6/1996 Shishido et al. ..... 355/200
5,642,187 A 6/1997 Nomura et al. ..... 399/111
5,650,841 A 7/1997 Matsuda et al. ..... 399/111
5,678,139 A 10/1997 Nomura et al. ..... 399/114
5,697,022 A 12/1997 Matsuda et al. ..... 399/102
5,825,472 A 10/1998 Araki et al. ..... 355/200
5,867,751 A 2/1999 Nomura et al. ..... 399/90
5,893,017 A * 4/1999 Yamamoto ..... 399/299
5,937,246 A * 8/1999 Kaneyama ..... 399/228
6,016,408 A 1/2000 Hashimoto et al. ..... 399/27
6,101,352 A 8/2000 Hashimoto et al. ..... 399/119
6,151,459 A 11/2000 Hashimoto et al. ..... 399/27
6,219,498 B1 * 4/2001 Katoh et al. ..... 399/45
6,272,300 B1 8/2001 Fujiwara et al. ..... 399/113

(Continued)

FOREIGN PATENT DOCUMENTS

JP 2001206593 A * 7/2001

(Continued)

*Primary Examiner*—Quana Grainger
(74) *Attorney, Agent, or Firm*—Fitzpatrick, Cella, Harper & Scinto

(57) ABSTRACT

A color electrophotographic image forming apparatus for forming an image on a recording material, includes (i) a mounting portion for detachably mounting process cartridges developing images with different colors and each including an electrophotographic photosensitive drum and a developing roller for developing an latent image formed on the drum, wherein roller is movable between a contact state contacting the drum and a spaced state spaced from the drum; (ii) a switching device switching the rollers between the contact and spacing states; (iii) a feeding belt for feeding the recording material along all of the drums; (iv) a controller for switching between a first monochrome mode in which the belt contacts all of the drums and a second monochrome mode in which the belt contacts only the drum of the cartridge which develops the latent image for image formation.

8 Claims, 8 Drawing Sheets

U.S. PATENT DOCUMENTS

| | | | | |
|---|---|---|---|---|
| 6,324,370 | B1 | 11/2001 | Isobe et al. | 399/258 |
| 6,347,198 | B1 | 2/2002 | Yamamoto et al. | 399/27 |
| 6,546,212 | B1 | 4/2003 | Ogata et al. | 399/24 |
| 6,564,029 | B2 | 5/2003 | Kojima et al. | 399/258 |
| 6,584,291 | B1 | 6/2003 | Yamamoto | 399/27 |
| 6,587,649 | B1 | 7/2003 | Yamamoto et al. | 399/27 |
| 6,594,451 | B2 | 7/2003 | Kakeshita et al. | 399/24 |
| 6,873,815 | B2 | 3/2005 | Matsuda et al. | 399/260 |
| 6,892,033 | B2 | 5/2005 | Sunada et al. | 399/13 |
| 6,912,366 | B1 | 6/2005 | Yamamoto et al. | 399/27 |
| 6,925,267 | B2 | 8/2005 | Yamamoto et al. | 399/27 |
| 6,968,147 | B2 | 11/2005 | Matsuda et al. | 399/258 |
| 6,980,755 | B2 | 12/2005 | Numagami et al. | 399/109 |
| 2001/0046493 | A1 | 11/2001 | Margolin et al. | 424/94.2 |
| 2003/0053809 | A1 | 3/2003 | Ogata et al. | 399/12 |
| 2003/0138270 | A1 | 7/2003 | Matsuoka | 399/228 |
| 2003/0175039 | A1 | 9/2003 | Yamamoto et al. | 399/27 |
| 2003/0215266 | A1* | 11/2003 | Ishida et al. | 399/223 |
| 2004/0042804 | A1 | 3/2004 | Yamamoto et al. | 399/27 |
| 2004/0136734 | A1* | 7/2004 | Yokobori et al. | 399/23 |
| 2005/0152716 | A1* | 7/2005 | Agata et al. | 399/223 |
| 2005/0220464 | A1 | 10/2005 | Kobayashi et al. | 399/27 |

FOREIGN PATENT DOCUMENTS

| | | |
|---|---|---|
| JP | 2001-305818 | 11/2001 |

* cited by examiner

IMAGE FORMING APPARATUS SWITCHING DEVELOPING ROLLERS OF MOUNTED PROCESS CARTRIDGES BETWEEN CONTACT AND SPACED STATES AND SWITCHING THE CONTACT POSITION OF A FEEDING BELT CONTACTABLE TO DRUMS OF THE MOUNTED CARTRIDGES

FIELD OF THE INVENTION AND RELATED ART

The present invention relates to an electrophotographic color image forming apparatus in which process cartridges are removably mountable.

As examples of an electrophotographic color image forming apparatus, an electrophotographic copying machine, an electrophotographic printer (for example, LED printer, laser beam printer, etc.), an electrophotographic facsimile machine, an electrophotographic word processor, which form images with the use of an electrophotographic image forming method, are included.

A process cartridge is a cartridge in which at least a developing means and an electrophotographic drum are integrally disposed, and which is removably mountable in the main assembly of an electrophotographic color image forming apparatus.

As an example of an electrophotographic color image forming apparatus, there is an electrophotographic color image forming apparatus of the inline type, which generally uses the following image forming method: First, four color toner images are formed of cyan, yellow, magenta, and black developers (which hereinafter may sometimes be referred to as cyan, yellow, magenta, and black toners, respectively), one for one, on four photosensitive drums, as electrophotographic members, one for one, which are disposed so that they perfectly overlap in the direction parallel to the direction in which a recording medium is conveyed by a conveyer belt while remaining electrostatically adhered to the conveyer belt. The color toner images formed on these photosensitive drums are sequentially transferred onto the recording medium.

When forming a monochromatic image, which usually is an image of black color, with the use of an electrophotographic color image forming apparatus of the above-mentioned inline type, only the photosensitive drum for forming a monochromatic image of a desired color, needs to be placed in contact with the conveyer belt. In other words, placing the photosensitive drums for forming the images of other colors (non-black) in contact with the conveyer belt is problematic in that as the photosensitive drums rotate in contact with the conveyer belt, their service lives shorten. For the purpose of solving this kind of problem, some electrophotographic color image forming apparatuses are structured so that when forming a monochromatic image, the three photosensitive drums for forming the monochromatic images other than the one for forming the monochromatic image, are kept separated from the electrostatic conveyer belt (Japanese Laid-open Patent Application 13-305818).

However, the structural arrangements in accordance with the prior art suffer from the following problem. That is, if the photosensitive drums, which are unnecessary for the formation of a monochromatic image of a given color, are kept separated from the conveyer belt, the electrostatic conveyer belt sometimes fail to precisely convey a non-standard recording medium (for example, thick paper, short envelop or post card, etc.) In other words, when conveying the above-mentioned non-standard recording media, the electrostatic force, alone, from the conveyer belt is insufficient to precisely convey these non-standard recording media, and therefore, it is possible that the non-standard recording media will be conveyed at a speed less than a predetermined recording medium conveyance speed, and/or the recording media will be conveyed askew, which in turns makes it possible for an image to fail to be transferred onto a predetermined location on the recording medium.

SUMMARY OF THE INVENTION

The primary object of the present invention is to provide an electrophotographic color image forming apparatus capable of accommodating more types of recording media than an electrophotographic color image forming apparatus in accordance with the prior art.

Another object of the present invention is to provide an electrophotographic color image forming apparatus capable of switching the recording medium conveying method, in accordance with the type of a recording medium used for image formation, in order to precisely convey a recording medium.

Another object of the present invention is to provide an electrophotographic color image forming apparatus capable of switching the recording medium conveying method in accordance with the type of a recording medium used for image formation, in order to precisely form an image on a recording medium.

Another object of the present invention is to provide an electrophotographic color image forming apparatus capable of making an electrophotographic photosensitive drum and a development roller last longer than an image forming apparatus in accordance with the prior art.

Another object of the present invention is to provide an electrophotographic color image forming apparatus capable of precisely transferring images onto a recording medium.

Another object of the present invention is to provide an electrophotographic color image forming apparatus for forming an image on recording medium, comprising: (i) a cartridge compartment in which a plurality of process cartridges have an electrophotographic photosensitive drum, and a development roller which is for developing an electrostatic latent image formed on the electrophotographic photosensitive drum, and which can be kept in contact with, or separated from, the electrophotographic photosensitive drum, and develop the latent image with different colors; (ii) a switching means for switching the state of the development roller in each process cartridge between the state in which the development roller is in contact with the electrophotographic photosensitive drum and the state in which it is not in contact with the electrophotographic photosensitive drum, after the mounting or the plurality of process cartridges into the cartridge compartment, (iii) a conveyer belt which conveys the recording medium along the electrophotographic photosensitive drum of each of the plurality of process cartridges in the cartridge compartment; and (iv) a control means capable of switching the operational mode of the image forming apparatus between a first monochromatic mode in which the conveyer belt is placed in contact with all of the electrophotographic photosensitive drums of the plurality of process cartridges, and a second monochromatic mode in which the conveyer belt is placed in contact with the electrophotographic photosensitive drum of only the process cartridge used for development, among the plurality of process cartridges in the cartridge compartment, the monochromatic modes being modes in which only one process cartridge among all the process cartridges in the cartridge compartment, is used for forming an image on the recording medium, and in which the process cartridges which are not used for image formation are kept separated from the corresponding electrophotographic photosensitive drums, by the switching means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatus in accordance with the present invention will be described in detail with reference to the appended drawings. The preferred embodiments, which will be described below, are intended to be used only for concretely describing the present invention. Thus, the measurements, materials, and shapes of the structural components of the image forming apparatuses in the following embodiments of the present invention, and their positional relationships, are not intended for limiting the scope of the present invention, unless specifically noted.

[General Structure of Image Forming Apparatus]

Figure 1:
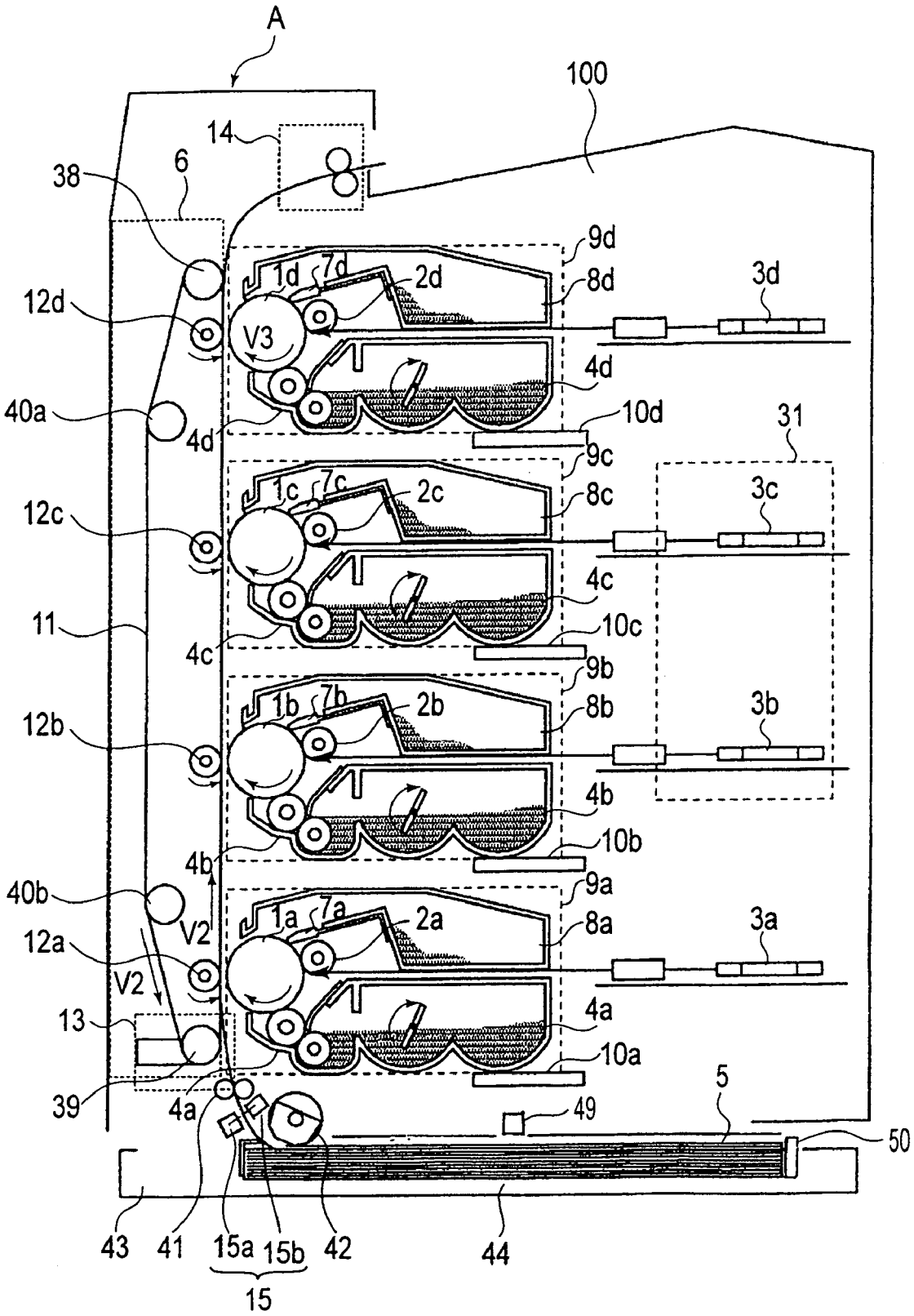
FIG. 1 is a schematic sectional drawing of the electrophotographic image forming apparatus in accordance with the present invention, showing the general structure thereof.

FIG. 1 shows an electrophotographic multicolor (four color) image forming apparatus A (which hereinafter will be referred to simply as image forming apparatus A), that is, a type of electrophotographic image forming apparatus, in the first embodiment of the present invention.

The image forming apparatus A in FIG. 1 is a color printer of an inline type. It has four photosensitive drums 1 (1*a*, 1*b*, 1*c*, and 1*d*) as electrophotographic photosensitive members, which are disposed so that they are vertically stacked in parallel to each other. In the adjacencies of the peripheral surface of each photosensitive drum 1, a charge roller 2 (2*a*, 2*b*, 2*c*, or 2*d*) for charging the peripheral surface of the photosensitive drum 1 to a predetermined potential level, a scanner unit (3*a*, 3*b*, 3*c*, or 3*d*) for projecting a beam of laser light, while modulating the beam with image formation data, to form an electrostatic latent image on the peripheral surface of the photosensitive drum 1, a development unit 4 (4*a*, 4*b*, 4*c*, or 4*d*) for adhering toner to the electrostatic latent image to develop it into a toner image, or the image formed of toner, a transferring apparatus 6 for transferring the toner image on the photosensitive drum 1 onto a recording medium 5, a cleaning apparatus 7 (7*a*, 7*b*, 7*c*, or 7*d*) for removing the transfer residual toner, that is, the toner remaining on the peripheral surface of the photosensitive drum 1 after the transfer, etc., are disposed in a manner to surround the photosensitive drum 1.

In this embodiment, the process cartridge 9 (9*a*, 9*b*, 9*c*, and 9*d*) (which hereinafter may be referred to simply as the cartridge) comprises the photosensitive drum 1, the charge roller 2, the development unit 4, and the cleaning apparatus 7, which are integrally disposed in the cartridge 9. The charge roller 2, the development unit 4, and the cleaning apparatus 7 are means for processing the photosensitive drum 1. The process cartridges 9 are removably mountable in the main assembly 100 of the image forming apparatus.

Also in this embodiment, all cartridges 9 (9*a*, 9*b*, 9*c*, and 9*d*) are the same in shape, and contain yellow, cyan, magenta, and black color toners, respectively.

Figure 2:
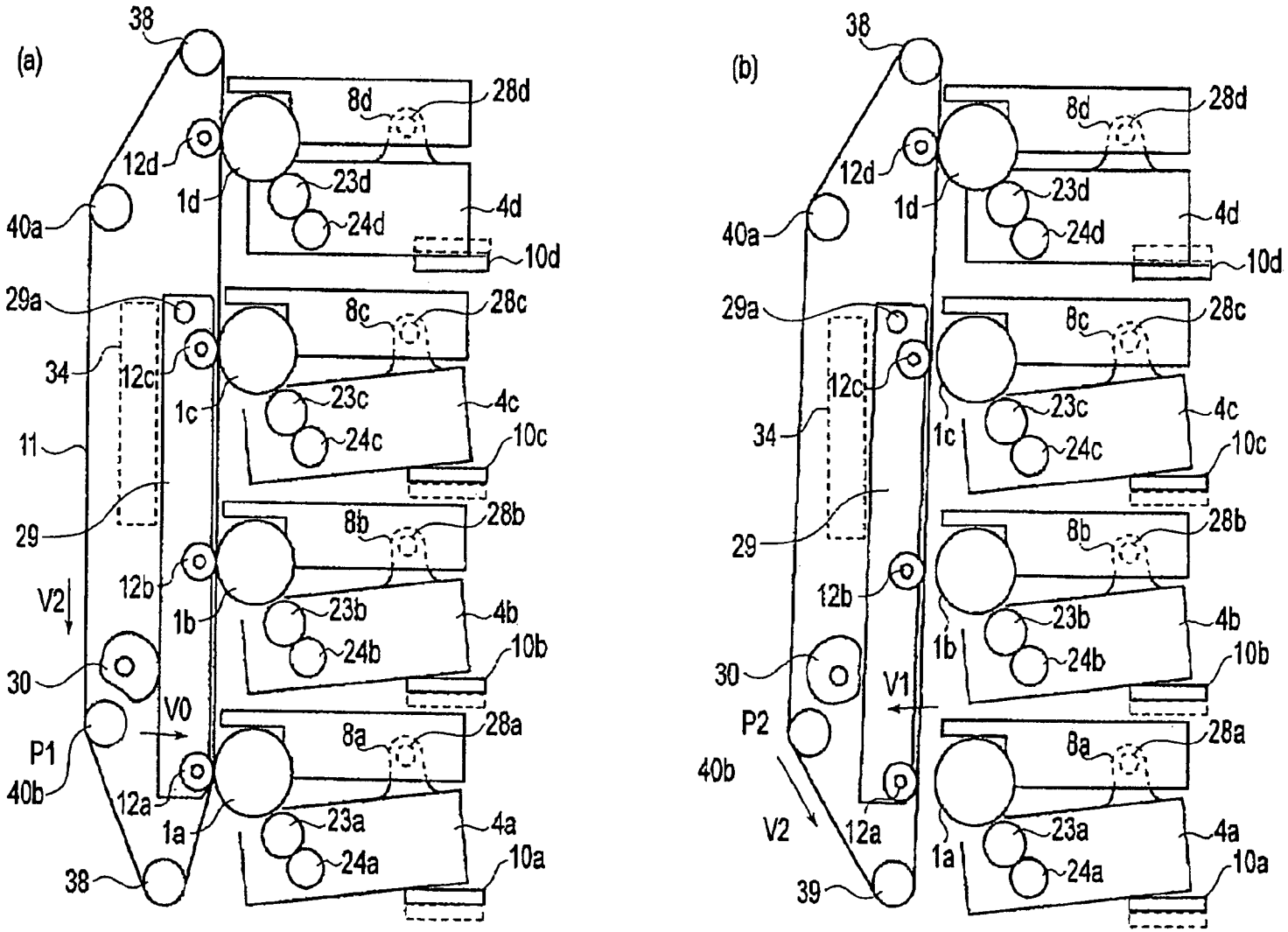
FIGS. 2(*a*) and 2(*b*) are schematic sectional drawings of the transferring portion of the electrophotographic image forming apparatus in accordance with the present invention, showing the general structure thereof.

A conveyer belt 11 for conveying the recording medium 5 is disposed so that it faces the photosensitive drum of each of the cartridges 9. The transfer rollers (12*a*, 12*b*, 12*c*, and 12*d*) are transferring members, which are in contact with the inward surface of the conveyer belt 11, in terms of the loop the conveyer belt 11 forms, and are disposed in parallel so that they overlap in the moving direction of the conveyer belt 11 (recording medium 5). Referring to FIGS. 2(*a*) and 2(*b*), the transfer rollers 12*a*, 12*b*, and 12*c* are rotatably attached to the transfer roller unit 29, which is attached to the frame of the main assembly 100 of the image forming apparatus A so that it can be rotated about the transfer roller unit supporting portion 29*a*. As for the transfer roller 12*d*, it is directly and rotatably attached to the frame of the main assembly 100 of the image forming apparatus A.

Figure 6:
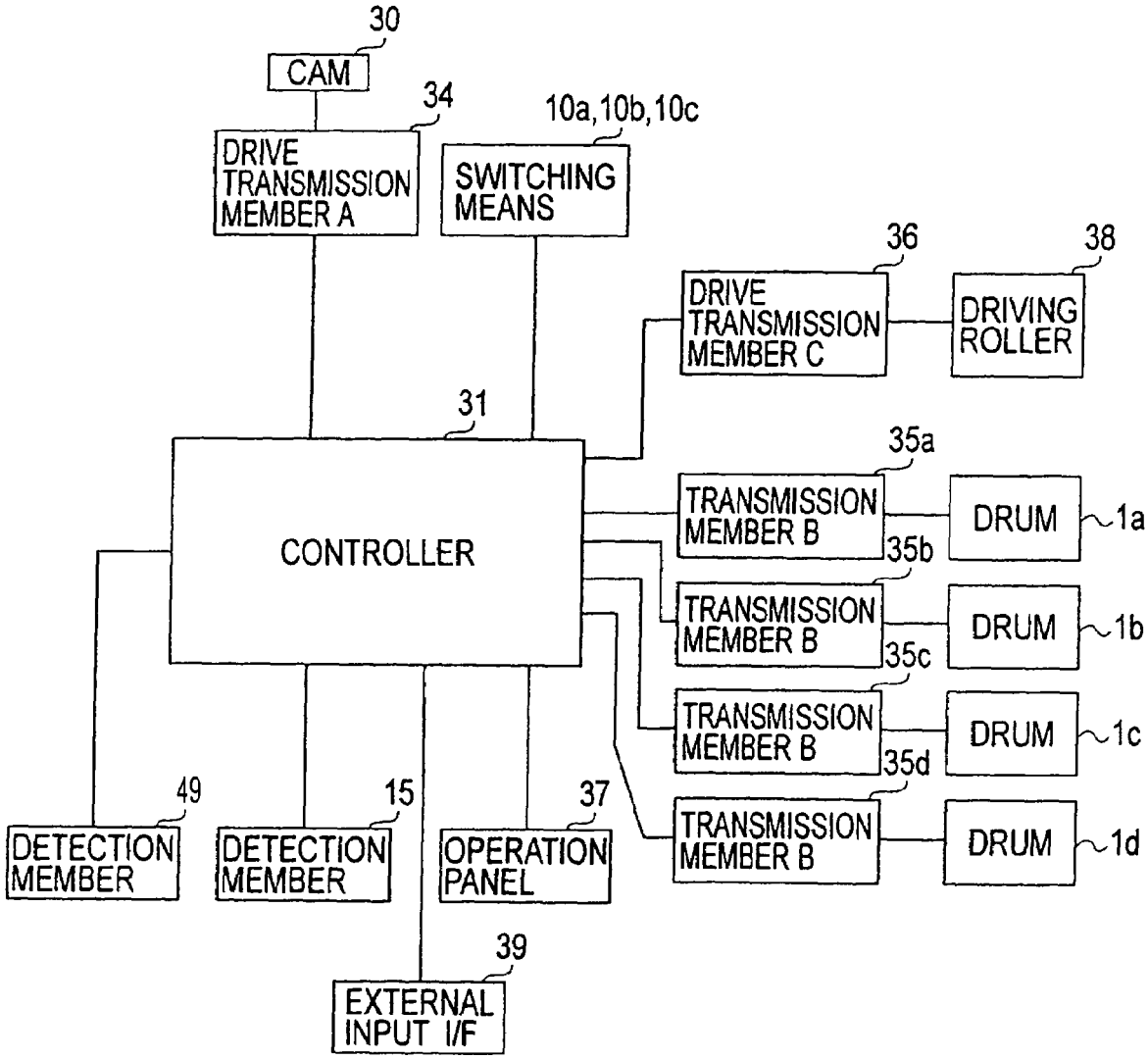
FIG. 6 is a block diagram of a device for controlling the electrophotographic image forming apparatus in accordance with the present invention.

Referring to FIG. 2(*a*), as a cam 30 is rotated into the angle P1 in which it contacts the transfer roller unit 29, the transfer roller unit 29 is moved into the position in which it keeps the conveyer belt 11 in contact with the photosensitive drums 1*a*, 1*b*, and 1*c*, and also, in which it keeps the transfer rollers 12*a*, 12*b*, and 12*c* pressed against the photosensitive drums 1*a*, 1*b*, and 1*c*, with the conveyer belt 11 pinched between the transfer rollers 12*a*, 12*b*, and 12*c* and the photosensitive drums 1*a*, 1*b*, and 1*c*, respectively (first position). Next referring to FIG. 2(*b*), as the cam 30 is rotated into the angle P2 in which it does not contact the transfer roller unit 29, the transfer roller unit 29 is rotated in the clockwise direction (V1 direction) about the supporting portion 29*a* from the position shown in FIG. 2(*a*). As a result, the transfer rollers 12*a*, 12*b*, and 12*c* are moved away from the photosensitive drums 1*a*, 1*b*, and 1*c*, respectively, and also, the conveyer belt 11 is moved by its own tension to the position (second position) in which it does not contact the photosensitive drums 1*a*, 1*b*, and 1*c*. Referring to FIG. 6, as for the control of the rotation of the cam 30, the driving force transmitting member A, denoted by reverence numeral 34 (unillustrated in FIG. 2(*a*), but shown in FIG. 6) is activated by the control portion 31 of the image forming apparatus A to stop the cam 30 in the first or second angles (P1 or P2). As the driving force transmitting member A, a stepping motor (unshown) or a clutch (unshown) connected to the cam 30 is employed.

The conveyer belt 11 in this embodiment is roughly 700 mm in circumference, and 150 m in thickness. It is stretched around four rollers, which are a driver roller 38, follower rollers 40*a* and 40*b*, and a tension roller 39. Thus, as the driver roller 38 is rotated by a motor (unshown), the conveyer belt 11 is circularly moved in the direction indicated by an arrow mark V2 as shown in FIG. 1. While the conveyer belt 11 is circularly moved, and therefore, the recording medium 5 is conveyed from the tension roller 39 side to the driver roller 38 side, toner images are transferred onto the recording medium 5.

A sheet feeding portion 43 is for feeding the recording medium 5 into the image forming portion. It comprises a cassette 44, in which a plurality of recording media 5 are stored. During an image forming operation, the feed roller 42 is rotated in synchronism with the progression of the image forming operation, feeding the recording media 5 from the cassette 44 into the main assembly 100, while separating one by one the recording media 5. After being fed into the main assembly 100, each recording medium 5 is temporarily held up by a registration shutter 41, as its leading edge comes into contact with the registration shutter 41. As a result, the recording medium 5 temporarily arches. Then, it is released by the registration shutter 41 on to the conveyer belt 11 so that the arrival of the transfer starting line on the recording medium 5 at the contact area between the conveyer belt 11 and photosensitive drum 1 coincides with the arrival of the leading end of the toner image on the photosensitive drum 1 at the contact area.

A fixing apparatus 14 is an apparatus for fixing a toner image to the recording medium 5 after the toner image is transferred onto the recording medium 5 After the transfer of the toner image onto the recording medium 5, the recording medium 5 is moved through the fixing apparatus 14. While the recording medium 5 is moved through the fixing apparatus, heat and pressure is applied to the combination of the recording medium 5 and the toner image thereon. As a result the toner image is permanently fixed to the surface of the recording medium 5.

[Structure of Process Cartridge]

Figure 3:
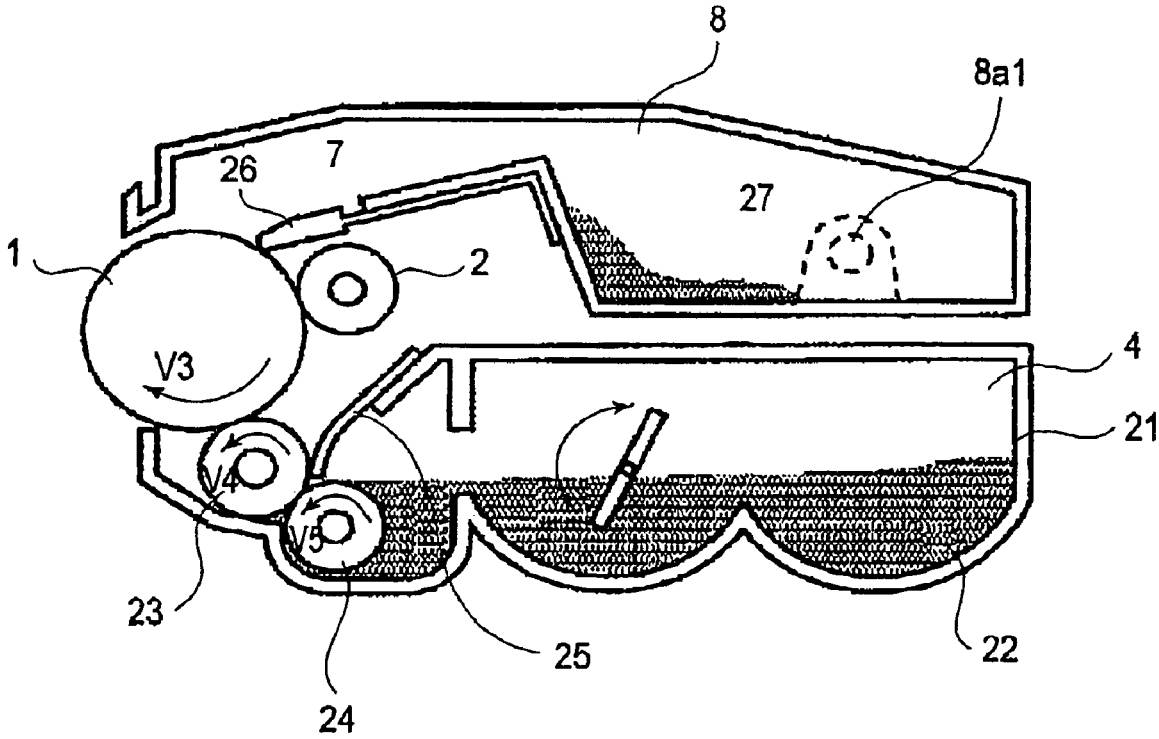
FIG. 3 is a schematic sectional drawing of the process cartridge for the electrophotographic image forming apparatus in accordance with the present invention, showing the general structure thereof.

Next, referring to FIG. 3, the cartridge 9 will be described. The cartridge 9 is separable into the cleaning unit 8 (8*a*, 8*b*, 8*c*, or 8*d*) and development unit 4 (4*a*, 4*b*, 4*c*, or 4*d*). The cleaning unit 8 has the photosensitive drum 1, the charge roller 2, the cleaning apparatus 7, and a toner storage container 27. The development unit 4 has the development roller 23, a development blade 25, and an elastic roller 24. The cleaning unit 8 and the development unit 4 are connected to each other so that they can pivot about the connective portion between the two. There is a pair of springs (unshown) between the cleaning unit 8 the and development unit 4 so that the photosensitive drum 1 and the development roller 23 are kept in contact with each other by the force from the pair of springs. Referring to FIG. 2, as each of the switching means (10*a*, 10*b*, and 10*c*) is moved upward, it comes into contact with the development unit 4 (4*a*, 4*b*, and 4*c*), and causes the development unit 4 to pivot about one of the supporting portions 28*a*, 28*b*, 28*c*, and 28*d*. As a result, the photosensitive drum 1 and development roller 23 become separated. On the other hand, as the switching means (10*a*, 10*b*, and 10*c*) is moved downward, it allows the development unit 4 (4*a*, 4*b*, and 4*c*) to pivot about one of the supporting portions 28*a*, 28*b*, 28*c*, and 28*d*. As a result, the switching means (10*a*, 10*b*, and 10*c*) becomes separated from the development unit 4. Therefore, the photosensitive drum 1 and the development roller 23 come into contact with each other. In other words, the switching means (10*a*, 10*b*, and 10*c*) is capable of switching the positional relationship between the photosensitive drum 1 and development unit 4 between the state in which the photosensitive drum 1 and development unit 4 are in contact with each other, and the state in which the two are not in contact with each other. As for the vertical movement of the switching means (10*a*, 10*b*, and 10*c*), it is controlled by the control portion 31 as shown in FIG. 6.

Next, each of the essential structural elements of the cartridge 9 will be described in detail.

First, the photosensitive drum 1 comprises an aluminum cylinder, and a photosensitive layer coated on the peripheral surface of the aluminum cylinder. Referring to FIGS. 1 and 3, the photosensitive drum 1 is rotated in the direction indicated by the arrow mark V3.

As the charge roller 2, a charge roller compatible with a contact charging method is employed. The charge roller 2 is an electrically conductive roller, and is placed in contact with the photosensitive drum 1. As charge bias is applied to the charge roller 2, the peripheral surface of the photosensitive drum 1 is uniformly charged.

The development unit 4 comprises: the development roller 23 which is rotated in contact with the photosensitive drum 1, in the direction indicated by an arrow mark V4; and a developer container 21 in which nonmagnetic toner 22 (which hereinafter may be referred to simply as toner) as single-component developer, the inherent polarity of which is negative, is stored. The developer container 21, which opposes the photosensitive drum 1, is provided with a hole, through which the development roller 23 is supplied with the toner 22, and which extends in the direction parallel to the lengthwise direction of the photosensitive drum 1 (development roller 23) so that the entire lengthwise range of the development roller 23 is supplied with the toner 22. The development roller 23 as a developer bearing means (developing means) is disposed in a manner of covering this hole. During an image forming operation, the development roller 23 is kept in contact with the photosensitive drum 1 so that it appears as if the development roller 23 is invaded into the photosensitive drum 1 by a predetermined distance. The development roller 23 is rotated in the direction indicated by the arrow mark V4.

The development unit 4 is also provided with the elastic roller 24, which is placed in contact with the development roller 23 to supply the development roller 23 with the toner 22, and also, to strip away from the development roller 23 the toner which was not used for development. The elastic roller 24 is rotatably supported by the developer container 21. As for the material of the roller proper of the elastic roller 24, foamed rubber is used to efficiently supply the development roller 23 with the toner 22, and also, to strip the residual toner from the development roller 23. The elastic roller 24 is rotated in the direction indicated by an arrow mark V5, which is the same as the direction as the development roller 23 is rotated.

Further, the development unit 4 is provided with the development blade 25 for regulating the amount by which the toner is allowed to be borne on the development roller 23. The development blade 25 is a piece of thin plate of phosphor bronze, which is elastic. It is disposed so that its free edge and the adjacencies of the free edge are placed in contact with the peripheral surface of the development roller 23. As the peripheral surface of the development roller 23 is rubbed by the peripheral surface of the elastic roller 24, the toner 22 is borne on the peripheral surface of the development roller 23, and is moved to the contact area between the development 1*b* roller 23 and development blade 25. Then, as the toner on the peripheral surface of the development roller 23 is moved through the contact area, the toner is formed into a uniform layer with a predetermined thickness, while being frictionally charged.

To the development roller 23 in the development unit 4, a DC bias (development bias) of a predetermined value is applied. As a result, the toner is adhered to the exposed points of the uniformly charged peripheral surface of the photosensitive drum 1 by the electrostatic force generated by the difference in potential level between the development roller 23 and the exposed points of the peripheral surface of the photosensitive drum 1; the latent image on the peripheral surface of the photosensitive drum 1 is reversely developed.

The photosensitive drum 1 is continuously rotated while the toner image is formed. Therefore, the portion of the peripheral surface of the photosensitive drum 1, across which the toner image has been formed, is brought by the rotation of the photosensitive drum 1 to the transfer portion, in which the transfer roller (12*a*, 12*b*, 12*c*, or 12*d*) is kept pressed against the peripheral surface of the photosensitive drum 1 (1*a*, 1*b*, 1*c*, or 1*d*), with the conveyer belt 11 pinched between the photosensitive drum 1 and transfer roller (12*a*, 12*b*, 12*c*, or 12*d*), and is moved through the transfer portion. While the portion of the peripheral surface of the photosensitive drum 1, across which the toner image has been form, is moved through the transfer portion, the toner image is transferred onto the recording medium 5 delivered to the transfer portion while remaining electrostatically adhered to the conveyer belt 11. The toner which remained on the photosensitive drum 1, that is, the toner which was not transferred onto the recording medium 5, is removed from the photosensitive drum 1 by the cleaning apparatus 7, which comprises a cleaning blade 26 and the toner storage container 27. The cleaning blade 26 is kept pressed on the peripheral surface of the photosensitive drum 1 so that a predetermined amount of contact pressure is maintained between the cleaning blade 26 and photosensitive drum 1. It removes the residual toner on the peripheral surface of the photosensitive drum 1 by mechanically scraping the peripheral surface of the photosensitive drum 1. The removed toner is stored in the toner storage container 27.

[Mounting of Process Cartridge into Image Forming Apparatus Main Assembly, and Removal of Process Cartridge, therefrom]

Figure 8:
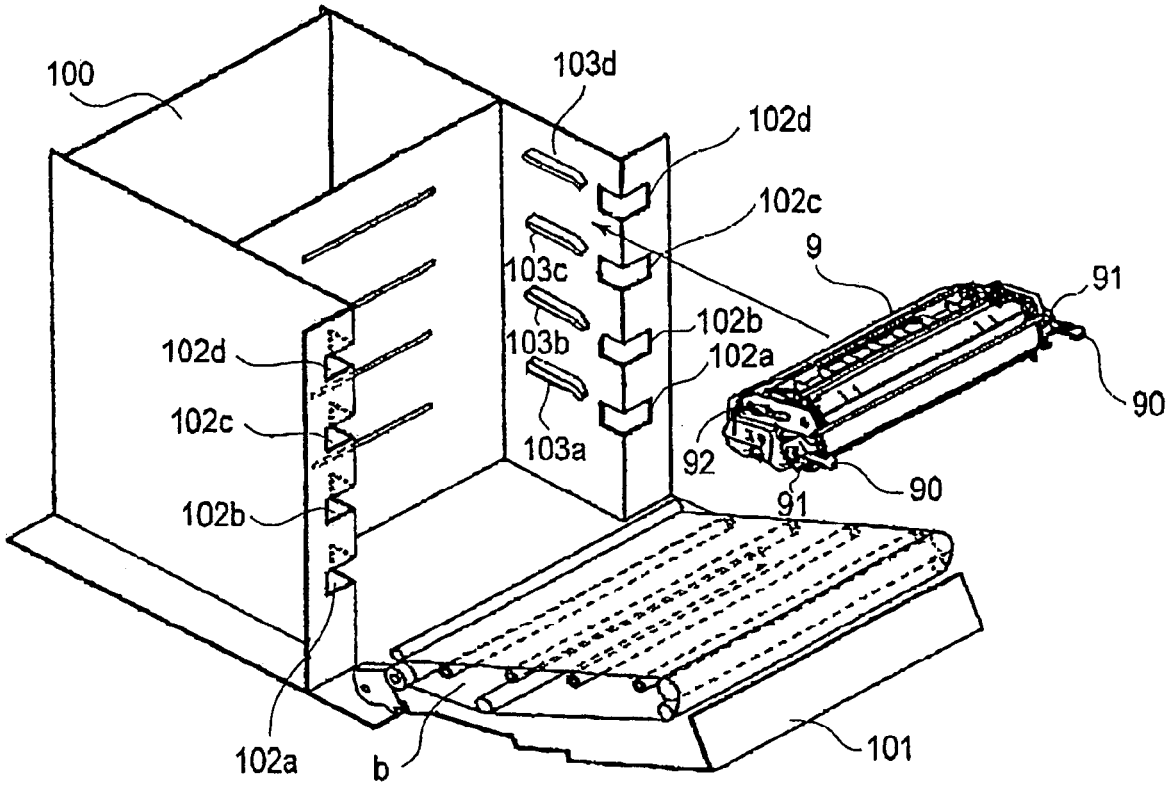
FIG. 8 is a schematic perspective drawing of the electrophotographic image forming apparatus in accordance with the present invention.

Next, referring to FIG. 8, the method for mounting the cartridge 9 into the main assembly 100 of the image forming apparatus, and the method for removing the cartridge 9 from the main assembly 100 will be described. As will be evident from FIG. 8, the main assembly 100 is provided with a front door 101, which is hinged so that it can be rotationally opened or closed. To the front door 101, a transferring apparatus 6 is pivotally attached. The cartridge 9 can be mounted into the main assembly 100 of the image forming apparatus, or removed therefrom, only when the front door 1 is open. The cartridge 9 is provided with a pair of handles 90, which are located at the lengthwise ends of the cartridge 9, one for one, and are to be grasped to mount or dismount the cartridge 9. When mounting the cartridge 9 into the main assembly 100, it is to be inserted into the main assembly so that the pair of insertion guides 92 of the cartridge 9, and the pair of cartridge positioning portion 91 of the cartridge 9, are fitted into the pair of guide rails (103*a*, 103*b*, 103*c*, or 103*d*) of the main assembly 100, and pair of cartridge positioning portions (102*a*, 102*b*, 102*c*, or 102*d*) of the main assembly 100, respectively.

[Full-Color Model]

Next, the operation of the image forming apparatus in this embodiment in the full-color mode will be described.

The full-color mode is a mode in which an image is formed with the use of all four cartridges 9 different in the color of the toner they contain. The switching between the monochromatic mode, which will be described later, and the full-color mode is automatically done by the control portion 31, which makes mode selection based on the signals sent from a personal computer (unshown) connected to the image forming apparatus through an external input IF (interface) 39.

Referring to FIG. 1, when the image forming apparatus A is in the full-color mode, the photosensitive drums 1 (1*a*, 1*b*, 1*c*, and 1*d*) are kept pressed against the transfer roller (12*a*, 12*b*, 12*c*, and 12*d*), with the conveyer belt 11 pinched between the photosensitive drums 1 and transfer rollers (12*a*, 12*b*, 12*c*, and 12*d*), respectively. Further, all photosensitive drums 1 (1*a*, 1*b*, 1*c*, and 1*d*) are in contact with the development rollers 23 (23*a*, 23*b*, 23*c*, and 23*d*), respectively. Thus, first, the image formed of the yellow toner is transferred onto the recording medium 5, as the recording medium 5 is conveyed by the conveyed belt 11 in the direction V2. Then, the toner images formed of the cyan, magenta, and black toners, one for one, are sequentially transferred in layers onto the recording medium 5. Thereafter, the recording medium 5 is separated from the conveyer belt 11, and is sent into the fixing apparatus 14, in which the toner images are permanently fixed to the recording medium 5, turning into a single full-color image. In each image forming portion, after the completion of the transfer of the toner image, the switching means is activated to separate the development roller 23 from the photosensitive drum 1, ending the image forming operation. The position of the switching means, in which the switching means finishes separating the development roller 23 from the photosensitive drum 1, is the home position of the switching means. Thus, when the next image forming operation is started, the switching means is in this home position.

[Monochromatic Mode]

Next, the monochromatic mode will be described. When the image forming apparatus is in the monochromatic mode, an image is formed with the use of only black toner. The cartridge 9 which contains the black toner is mounted topmost among the vertically stacked four cartridges 9 different in the color of the toner they contain.

Figure 4:
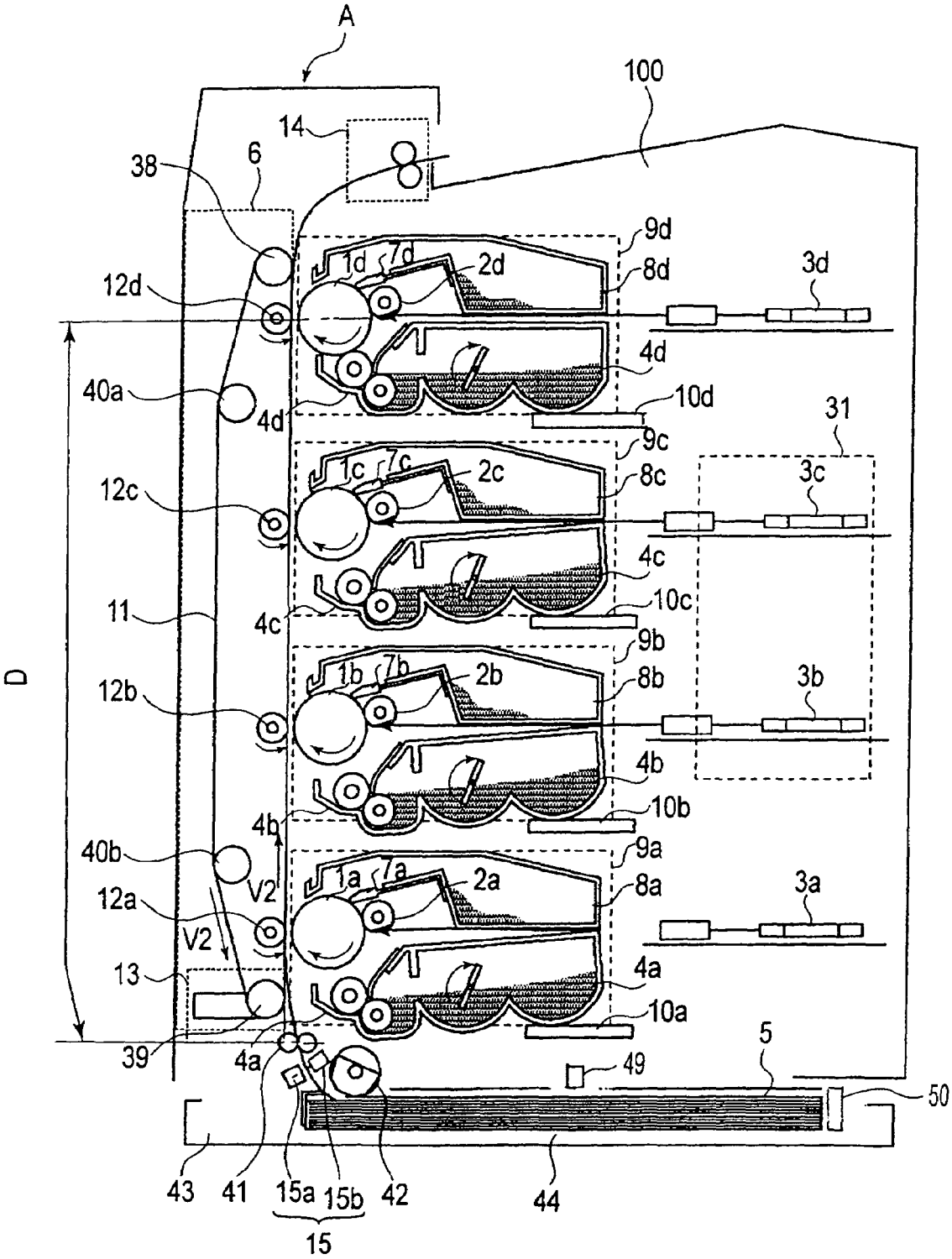
FIG. 4 is a schematic sectional drawing of the electrophotographic image forming apparatus in accordance with the present invention, in the first monochromatic mode, showing the general structure thereof.
Figure 5:
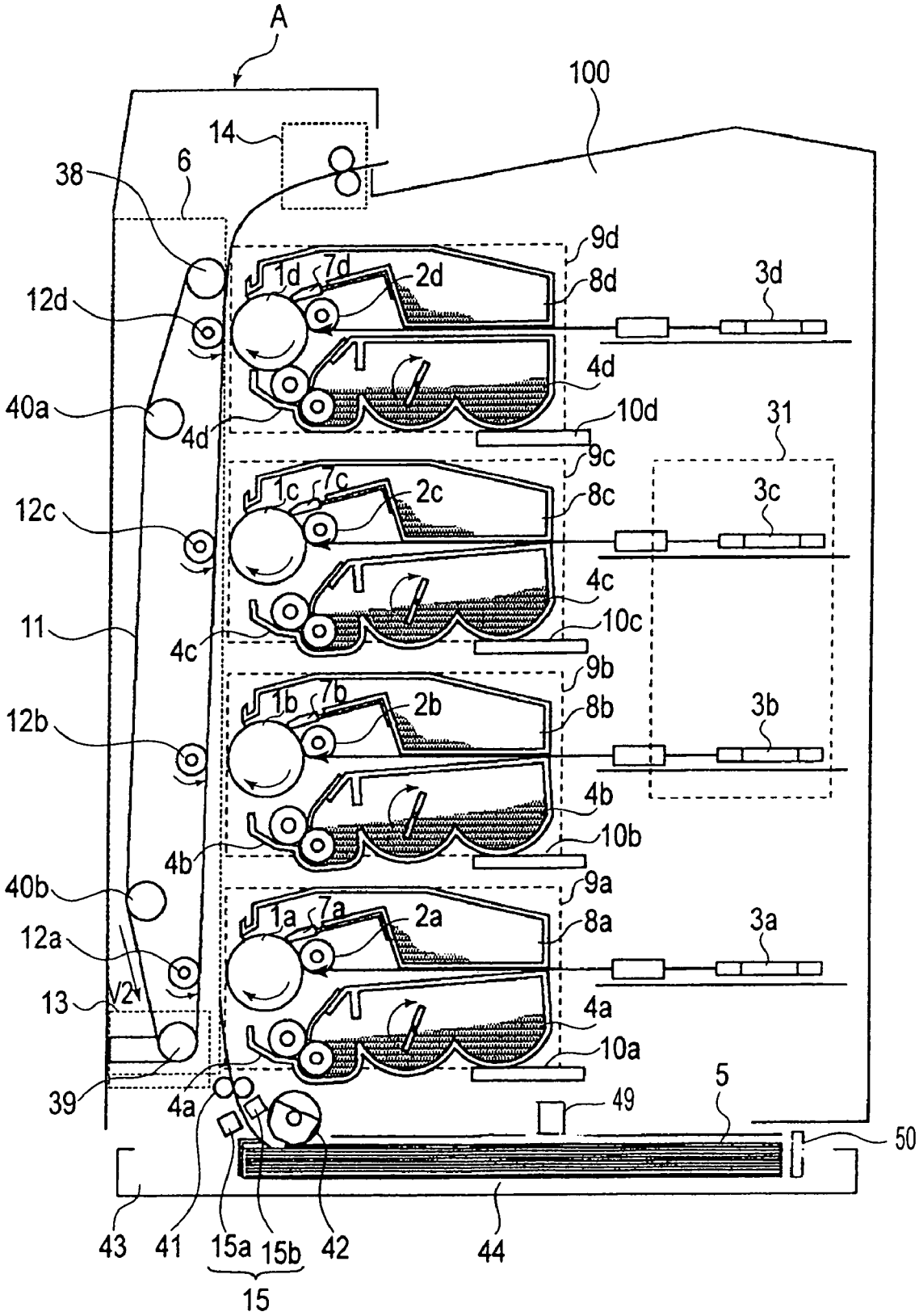
FIG. 5 is a schematic sectional drawing of the electrophotographic image forming apparatus in accordance with the present invention, in the second monochromatic mode, showing the general structure thereof.

The image forming apparatus in this embodiment is operable in first and second monochromatic modes. The first monochromatic mode is to be selected when a piece of thick paper (no less than 90 g/m in basis weight), a short envelope, a Japanese postcard of the standard size (100×148 nm), or the like, is conveyed as the recording medium through the image forming apparatus. The type of the recording medium is detected by detecting means 15 and 49. Whether or not a recording medium is thick paper can be determined based on the transmittance of the recording medium, which can be determined by measuring the amount of the light which comes through the recording medium from an LED positioned on the opposite side of the recording medium. More specifically, referring to FIGS. 1 and 4, the detecting member 15 has a light projecting portion 15*a* and a light receiving portion 15*b*. Thus, the thickness of the recording medium 5 is determined by measuring the amount of the light which comes through the recording medium from the LED while the recording medium 5 is moving between the light projecting portion 15*a* and light receiving portion 15*b*. The thickness of the recording medium 5 is measured before the recording medium 5 begins to be conveyed by the pair of registration rollers 41.

The length of the recording medium 5 is measured by the detecting member 49, More specifically, it can be determined by measuring the length of time between when the rotation of the feed roller 42 is started, and when the trailing edge of the recording medium 5 passes the detecting means 49. The length of the recording medium 5 can also be determined by employing a pair of the detecting members 49 and detecting the position of the regulating guide 50 which regulates the trailing edge of the recording medium 5 when the recording medium 5 is in the cassette 43.

However, the thickness and length of the recording medium 5 may be inputted by a user through the control panel of the image forming apparatus, as shown in FIG. 6, instead of allowing the control portion 31 to automatically determine the thickness and length of the recording medium based on the outputs of the detecting means 15 and 49. Further, they may be inputted by a user through the external input IF 39 connected to a personal computer (unshown).

In the first monochromatic mode, the cam 30 is made to take the angle P1 (first angle), into which it is moved by pivoting the transfer roller unit 29 in the direction indicated by an arrow mark V0 so that the conveyer belt 11 is placed in contact with the photosensitive drums 1*a*, 1*b*, and 1*c*, and also, so that the transfer rollers 12*a*, 12*b*, and 12*c* are pressed against the photosensitive drums 1*a*, 1*b*, and 1*c*, with the conveyer roller 11 pinched by the transfer rollers 12*a*, 12*b*, and 12*c* and photosensitive drums 1, respectively. Then, the switching means 10*d* of the only the development roller 23*d* which uses the black toner is activated to place the development roller 23*d* in contact with the photosensitive drum 1*d* from among the development rollers 23 which are kept away from the corresponding photosensitive drums 1 unless the image forming apparatus is forming an image. As for the photosensitive drums 1*a*, 1*b*, and 1*d*, that is, the photosensitive drums 1 other than the photosensitive drum 1*d* on which an image is formed of the black toner, they are rotated in contact with the conveyer belt 11, without being charged by the charge rollers 2*a*, 2*b*, and 2*c*, respectively. In other words, they play only the role of conveying the recording medium 5. To described in more detail, the cartridge 9*d* which uses the black toner is located topmost in the image forming apparatus A among the four cartridges 9. Therefore, the electrostatic force alone from the conveyer belt 11 is insufficient to keep the nonstandard recording media, such as the abovementioned piece of thick paper, a short envelop, a Japanese postcard, etc., precisely adhered to the conveyer belt 11 until they are delivered to the transfer station between the transfer roller 12*d* and photosensitive drum 1*d*. That is, the distance D1 (distance by which recording medium is conveyed) from the pair of registration rollers 41 to the photosensitive drum 1*d* is rendered longer than the lengths of such non-standard recording media as the above described ones. In this embodiment, however, the image forming apparatus is structured and operated as described above. Therefore, even if the non-standard media such as the abovementioned ones are used as the recording medium 5, the problem that they are conveyed at a slower speed than the normal speed, and/or conveyed askew does not occur. Therefore, the toner images are precisely transferred from the photosensitive drum 1*d* even onto the non-standard recording medium. Thus, from the standpoint of improving the image forming apparatus in terms of the precision with which the recording medium is conveyed, it is more effective to set the control portion 31 so that if the recording medium length is no more than D1, the first monochromatic mode is selected.

As for the second monochromatic mode, it is selected when the image forming apparatus is operated in a mode other than the first monochromatic mode. That is, it is used for conveying the standard recording paper, or the recording paper other such non-standard recording media as the abovementioned ones. More specifically, it is used when a monochromatic image is formed on such recording media as recording papers of A3, A4, and B5 sizes, recording papers of letter and legal sizes, etc. Referring to FIG. 2(*a*), in the second monochromatic mode, the cam 30 is kept at an angle P2 to prevent the cam 30 from applying pressure upon the transfer roller unit 29. To describe in more detail, as the cam 30 which has been kept at the angle P1 is rotated into the angle P2, the transfer roller unit 29 is allowed to pivot about the supporting portion 29*a* in the direction indicated by the arrow mark V1. As the transfer roller unit 29 rotates in the arrow V1 direction, the transfer rollers 12*a* are moved in the arrow V1 direction, becoming thereby separated from the photosensitive drums 1*a*, 1*b*, and 1*c*, respectively, and also, the conveyer belt 11 moves, due to its own tension, to the position (second position) in which it remains separated from the photosensitive drums 1*a*, 1*b*, and 1*c*. Then, only the switching means 10*d* for the development roller 23*d*, among the development rollers 23 which have been kept separated from the corresponding development roller 23, is activated to place the development roller 23*d* in contact with the photosensitive drum 1*d*. Thus, the development roller is placed in contact with the photosensitive drum 1 only in the cartridge 9*d* in which an latent image is to be developed. In other words, when the standard recording paper is used as the recording medium 5, the combination of the electrostatic force from the conveyer belt 11 and the conveyance force (friction) from the pair of registration rollers 41 is sufficient to precisely convey the recording medium 5. Therefore, there is no need for keeping the transfer rollers 12*a*, 12*b*, and 12*c*, pressed against the photosensitive drums 1*a*, 1*b*, and 1*c*, with the conveyer belt 11 pinched between the transfer belts and photosensitive drums 1, respectively. Further, it is also unnecessary to driving the photosensitive drums 1*a*, 1*b*, and 1*c*, and therefore, the driving force is not transmitted thereto from the main assembly 100 of the image forming apparatus A. In other words, the photosensitive drums 1*a*, 1*b*, and 1*c*, and the development rollers 23*a*, 23*b*, and 23*c*, which are not involved in the formation of a black monochromatic image, are not rotated. Therefore the photosensitive drums 1*a*, 1*b*, and 1*c*, and the development rollers 23*a*, 23*b*, and 23*c* last longer.

In the monochromatic mode in this embodiment, an image is formed of the black toner. However, a monochromatic image may be formed of one of the toners other than the black toner.

Figure 7:
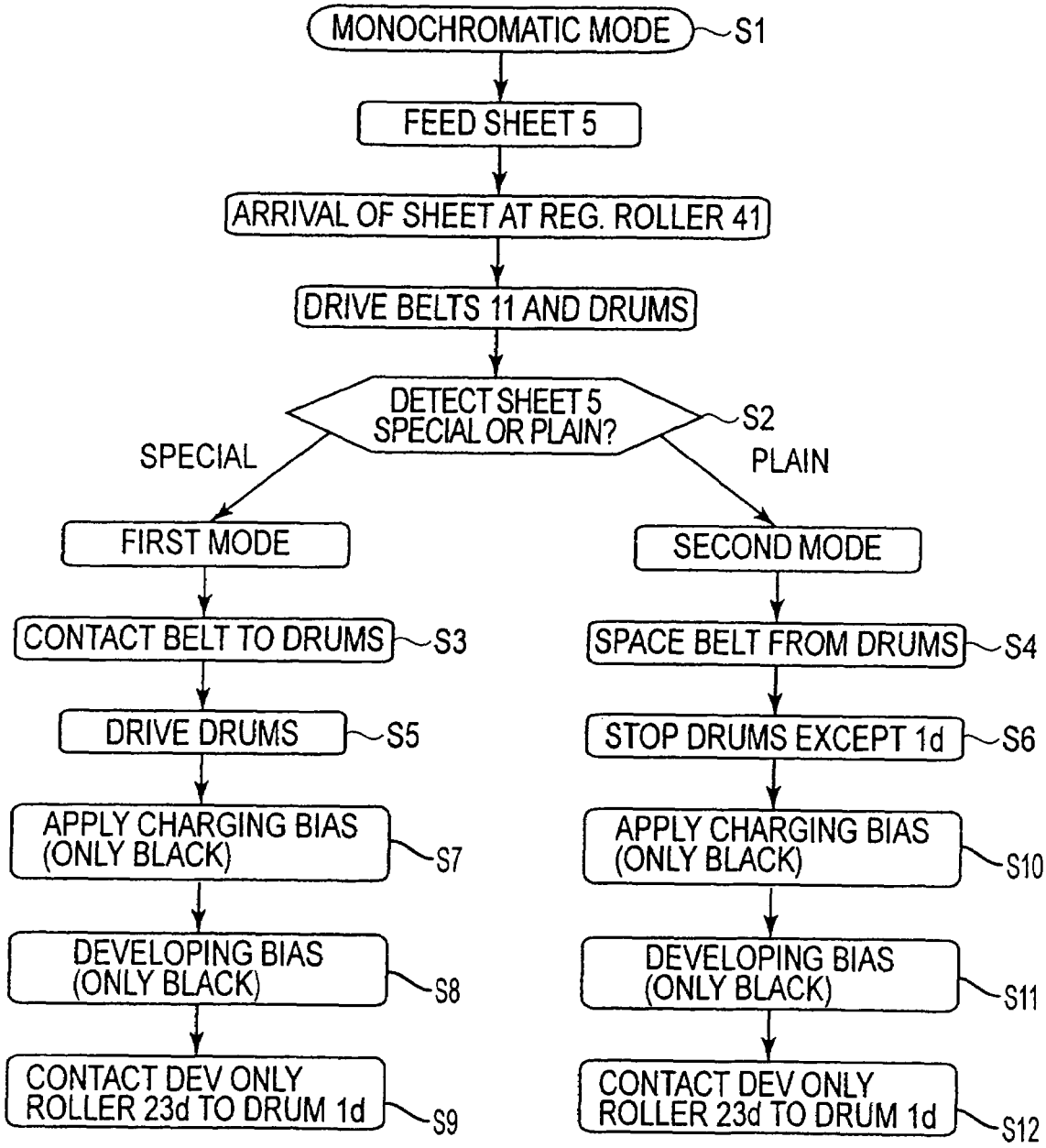
FIG. 7 is a flowchart for the control system of the electrophotographic image forming apparatus in accordance with the present invention.

FIG. 6 is a block diagram of the control system for controlling the image forming apparatus in this embodiment, and FIG. 7 is a flowchart for a method for controlling the image forming apparatus in this embodiment. First, referring to FIG. 6, as the monochromatic mode is selected (S1), that is, when the image forming apparatus is in the monochromatic mode, after the recording medium 5 reaches the pair of registration rollers 41, the driving force transmitting members B, denoted by a 35*a*, 35*b*, 35*c*, and 35*d*, and a driving force transmission member C denoted by reference numeral 36 are activated to simultaneously drive the conveyer belt 11 and photosensitive drums 1. The driving force transmitting members B are members for transmitting driving force to the photosensitive drums 1*a*, 1*b*, 1*c*, and 1*d*, one for one, and are stepping motors (unshown) or clutches (unshown). The driving force transmitting member 36 is a member for transmitting driving force to the driver roller 38, and is a stepping motor (unshown) or a clutch (unshown). At this point in the image forming operation, the photosensitive drum 1 is not in contact with the development roller 23, because the switching means is in the home position.

Next, the signals outputted from the detecting means 15 or 49 are interpreted by the control portion 31. In other words, the control portion 31 determines the type of the recording medium 5 by obtaining the information regarding the thickness or length of the recording medium 5, and selects (S2) the first or second monochromatic mode based on the determined type of the recording medium 5 (whether the recording medium 5 is non-standard or standard paper) Incidentally, the mode may be directly selected by a user through the control panel 37 as described before. As the control portion 31 selects the first monochromatic mode, it puts the driving force transmitting member A, denoted by the reference numeral 34 into action, rotating thereby the cam 30 so that the conveyer belt 11 is moved into the first position in contact with the photosensitive drums 1 (S3). It should be noted here that normally, before the beginning of an image forming operation, the photosensitive drums 1 are in contact with conveyer belt 11, and therefore, this step S3 is to be carried out only when the photosensitive drums 1*a*, 1*b*, and 1*c* are not in contact with the conveyer belt 11. Also, as the first monochromatic mode is selected, the driving force transmitting members B and C are put into action to begin continuously driving the photosensitive drums 1 (S5). Next, charge bias and development bias begin to be applied only to the cartridge 9*d* among the cartridges 9 in which the development roller 23 is not in contact with the photosensitive drum 1 (S7 and S8). Then, only the switching means for the cartridge 9*d* is put into action to place the development roller 23*d* in contact with the photosensitive drum 1*d* (S9), placing the image forming apparatus in the state shown in FIG. 2(*a*).

Next, as the second monochromatic mode is selected, the driving force transmitting member 34 is put into action to rotate the cam 30 so that the conveyer belt 11 is moved back to the second position to space the conveyer belt 11 from the photosensitive drums 1 (S4). The driving force transmitting member 36 is put into action to begin continuously driving the conveyer belt 11. However, the driving force transmitting members 35*a*, 35*b*, and 35*c* are left inactive, whereas the driving force transmitting member 35*d* is put into action. Therefore, the photosensitive drums 1*a*, 1*b*, and 1*c* are not rotated, and only the photosensitive drum 1*d*, or the photosensitive drum 1 to be developed with the black toner, is rotated (S6). Then, the charge bias and development bias are applied to the cartridge 9*d*, or the cartridge for forming an image with the use of the black toner, among the cartridges 9 in which the development roller 23 is not in contact with the photosensitive drum 1 (S10 and S11). Next, only the switching means 10 for the cartridge 9*d*, or the cartridge having the photosensitive drum 1*d* and the development roller 23*d*, which form an image with the use of the black toner, is put into action, among the cartridges 9 in which the development roller 23 is not in contact with the photosensitive drum 1, in order to place the development roller 23*d* in contact with the photosensitive drum 1*d* (S12), placing thereby the image forming apparatus in the state shown in FIG. 2(*b*).

As described above, this embodiment can increase the selections of the recording media 5 usable for image formation. Further, in this embodiment, the method in which the recording medium 5 is conveyed is switched, based on the type of the recording medium 5 used for image formation, and therefore, recording medium is precisely conveyed, and also, an image is precisely formed on the recording medium 5. Also in this embodiment, the photosensitive drums 1 and development rollers 23 are not rotated unless they need to be rotated. Therefore, the photosensitive drums 1 and the development roller 23 last longer. Also in this embodiment, an image is precisely transferred onto the recording medium 5.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 004117/2004 and 362868/2004 filed Jan. 9, 2004 and Dec. 15, 2004, respectively, which are hereby incorporated by reference.

What is claimed is:

1. A color electrophotographic image forming apparatus for forming an image on a recording material, said apparatus comprising:

(i) a mounting portion configured and positioned to detachably mount a plurality of process cartridges substantially along a vertical line, said process cartridges each including an electrophotographic photosensitive drum and a developing roller configured and positioned to develop an electrostatic latent image formed on the electrophotographic photosensitive drum, wherein the developing roller is movable between a contact state where the developing roller contacts the electrophotographic photosensitive drum and a spaced state where the developing roller is spaced from the electrophotographic photosensitive drum, wherein the process cartridges develop the electrostatic latent images with colors different from each other including black developer and non-black developers;

(ii) a driving force transmitting member configured and positioned to selectively transmit a driving force for rotating the electrophotographic photosensitive drum to the process cartridges;

(iii) switching means for switching the developing rollers between the contact state and the spaced state when the process cartridges are set in said mounting portion;

(iv) a feeding belt configured and positioned to feed the recording material along all of the electrophotographic photosensitive drums of the process cartridges set in the mounting portion;

(v) a first transfer roller which is rotatable is supported on a main assembly of said color electrophotographic image forming apparatus and which is urged toward said electrophotographic photosensitive drum provided in the process cartridge containing a black developer, with said feeding belt interposed therebetween;

(vi) a transfer roller unit which is rotatable is supported on the main assembly of said color electrophotographic image forming apparatus and which rotatably supports a plurality of second transfer rollers, wherein said transfer roller unit is movable between a contact position wherein said second transfer rollers are urged toward said electrophotographic photosensitive drums provided in the process cartridges containing non-black developers, with said feeding belt interposed therebetween, and a spacing position wherein said second transfer rollers are not urged toward said electrophotographic photosensitive drums provided in the process cartridges containing non-black developers; and (vii) control means for determining the kind of recording material and for switching, in accordance with the determined kind of the recording material on which an image is formed in a monochromatic image forming operation, between a first mode in which said transfer roller unit is placed at said contact position, and a second mode in which said transfer roller unit is placed at said spacing position;

wherein in the monochromatic image forming operation, the image is formed on the recording material through development performed in only one of said process cartridges, and wherein in a process cartridge in which no development is performed in the monochromatic image forming operation, said switching means switches the developing roller to be in the spaced state.

2. An apparatus according to claim 1, wherein said mounting portion has a mounting position for the process cartridge which is used in the monochromatic image forming operation, which position is above another mounting position for mounting another of the process cartridges.

3. An apparatus according to claim 1, further comprising detecting means for detecting the kind of the recording material, wherein said control means switches, in the monochromatic image forming operation between the first mode and the second mode in accordance with an output of said detecting means.

4. An apparatus according to claim 3, wherein said detecting means detects the length of the recording material in a feeding direction in which the recording material is fed, wherein said control means switches to the first mode when the output of said detecting means is indicative of a length less than a predetermined length and switches to the second mode when the output of said detecting means is indicative of a length not less than the predetermined length.

5. An apparatus according to claim 4, wherein the predetermined length corresponds to a distance, measured along the feeding direction, from a feeding roller disposed immediately before said feeding belt with respect to a feeding direction of said recording material to a position of contact between a transfer belt and said electrophotographic photosensitive drum of the process cartridge in which the development is performed in the monochromatic image forming operation.

6. An apparatus according to claim 3, wherein said detecting means detects the thickness of the recording material, and wherein said control means switches to the first mode when an output of said detecting means is indicative of a thickness not less than a predetermined thickness and switches to the second mode when the output of said detecting means is indicative of a thickness less than a predetermined thickness.

7. An apparatus according to claim 6, wherein the predetermined thickness corresponds to a basis weight of 90 g/m of the recording material.

8. An apparatus according to claim 1, wherein said feeding belt attracts the recording material thereon.

* * * * *

UNITED STATES PATENT AND TRADEMARK OFFICE

CERTIFICATE OF CORRECTION

PATENT NO. : 7,200,350 B2
APPLICATION NO. : 11/030040
DATED : April 3, 2007
INVENTOR(S) : Shinichi Agata et al.

It is certified that error appears in the above-identified patent and that said Letters Patent is hereby corrected as shown below:

ON THE TITLE PAGE:
In the "(56) REFERENCES CITED, FOREIGN PATENT DOCUMENTS" section, "2001206593 A" should read --2001-206593 A--.

ON THE TITLE PAGE:
In the "(57) ABSTRACT" section, line 6, "an" should read --a--.

COLUMN 1:
Line 65, "fail" should read --fails--.

COLUMN 2:
Line 54, "compartment," should read --compartment;--.

COLUMN 5:
Line 36, "medium 5," should read --medium 5.--.
Line 40, "is" should read --are--.
Line 56, "the and" should read --and the--.

COLUMN 7:
Line 5, "1b" should be deleted.
Line 30, "form," should read --formed,--.
Line 67, "portion" should read --portions--.

COLUMN 8:
Line 19, "roller" should read --rollers--.
Line 27, "conveyed" second occurrence, should read --conveyer--.

COLUMN 9:
Line 47, "described," should read --describe--.

COLUMN 10:
Line 35, "an" should read --a--.

UNITED STATES PATENT AND TRADEMARK OFFICE

CERTIFICATE OF CORRECTION

PATENT NO. : 7,200,350 B2
APPLICATION NO. : 11/030040
DATED : April 3, 2007
INVENTOR(S) : Shinichi Agata et al.

It is certified that error appears in the above-identified patent and that said Letters Patent is hereby corrected as shown below:

COLUMN 11:
Line 20, “paper)” should read --paper).--.

Signed and Sealed this

Third Day of February, 2009

John Doll

JOHN DOLL
*Acting Director of the United States Patent and Trademark Office*